United States Patent [19]

Rose

[11] Patent Number: 4,546,219

[45] Date of Patent: Oct. 8, 1985

[54] MULTI-STAGE ROTARY SWITCH WITH A VARIABLE CONTROL-SPAN RESTRICTION

[75] Inventor: Jochen Rose, Röthenbach, Fed. Rep. of Germany

[73] Assignee: ITT Industries, Inc., New York, N.Y.

[21] Appl. No.: 425,299

[22] Filed: Sep. 28, 1982

[30] Foreign Application Priority Data

Oct. 2, 1981 [DE] Fed. Rep. of Germany ..... 3139205

[51] Int. Cl.[4] ..... H01H 19/58; H01H 21/02; H01H 21/78

[52] U.S. Cl. ..... 200/11 R; 200/14

[58] Field of Search ..... 200/11 R, 11 A, 11 D, 200/11 DA, 11 G, 11 J, 11 K, 11 TW, 14, 291

[56] References Cited

U.S. PATENT DOCUMENTS

| | | | |
|---|---|---|---|
| 3,222,465 | 12/1965 | Huntress et al. | 200/11 TW |
| 3,803,370 | 4/1974 | Garcia | 200/11 J |
| 3,903,383 | 9/1975 | Marker | 200/11 TW |
| 4,356,360 | 10/1982 | Volz | 200/11 R |

FOREIGN PATENT DOCUMENTS

| | | | |
|---|---|---|---|
| 1282372 | 7/1972 | United Kingdom . | |
| 1438329 | 6/1976 | United Kingdom . | |
| 1566240 | 4/1980 | United Kingdom . | |
| 2107126A | 4/1983 | United Kingdom | 200/11 R |
| 2108320 | 5/1983 | United Kingdom | 200/11 R |

*Primary Examiner*—J. R. Scott

*Attorney, Agent, or Firm*—James B. Raden; William J. Michals

[57] ABSTRACT

A rotary switch having a rotor and a housing and providing a plurality of angular switch positions or stages. The switch includes a plurality of radial slots in the housing having stop pins selectively inserted therein. The angular spacing between neighboring slots is twice the position angle or rotation from one switch position to the other. One or two stop bolts are mounted on the rotor at angular positions between the angular positions of a selected pair of stop pins in the housing. The stop bolts are separated from one another by a spacing equal to the position angle of rotation. The stop bolts engage the stop pins to limit the desired number of stages or switch positions. By selecting a corresponding combination of one or more stop pins and the arrangement of one or two stop bolts, any odd or even number of switch positions, each separated by the minimum angle or rotation, can be selected.

18 Claims, 6 Drawing Figures

MULTI-STAGE ROTARY SWITCH WITH A VARIABLE CONTROL-SPAN RESTRICTION

BACKGROUND OF THE INVENTION

The present invention relates to a multi-position rotary switch with a variable control-span restriction, with a limit stop being provided on a rotor connected to the shaft and cooperating with at least one stop element inserted inside the casing in different radially extending recesses and spaced apart by equal angular degrees.

In a prior art multi-stage rotary switch, radial slots are provided for on the inside of the housing cover. The neighboring slots are arranged at an angular spacing corresponding to the angle or rotation from one switch position to the other. The slots are interrupted by a annular channel in which one stop journal of the rotor moves. The control-span restriction is effected by one or two stop pins inserted in one or two of the slots, against which the stop journal of the rotor meets.

With a continuing miniaturization and/or enlargement of the number of engaging steps, hence as the reduction of the angles or rotation between two stages continues, the slots must always be moved nearer to each other. This, however, is only possible up to a certain lower limit, because otherwise the slots towards the center point are not sufficiently separated from one another. This insufficient separation may result in deformation of the stop pins. This would lead to a reduction or the limiting stop torque.

It is the object of the present invention, therefore, to be able to reduce in size the switches of the aforementioned kind and/or to increase the number of steps without causing the disadvantages referred to hereinbefore.

SUMMARY OF THE INVENTION

According to the invention, this object is achieved in that the size of the angle between two neighboring recesses is made twice the angle or rotation from one step to the next one, and that one limit stop or the rotor is staggered either not at all or by an angle of rotation in the clockwise or anticlockwise direction, or that two limit stops are staggered with respect to one another by the angle or rotation. In this way, the limiting stop strength of the stop pins supported in the stops, continues to be safeguarded. The arrangement of the stops in the rotor staggered by an angle of rotation is possible because the circle on which they are arranged is substantially larger than the circle on which the inner ends of the slots are positioned. Further advantageous features of the invention are set forth in the description which follows.

BRIEF DESCRIPTION OF THE DRAWING

The invention will now be explained in greater detail with reference to an example of embodiment shown in FIGS. 1 to 6 of the accompanying drawings, in which.

DETAILED DESCRIPTION

Figure 1:
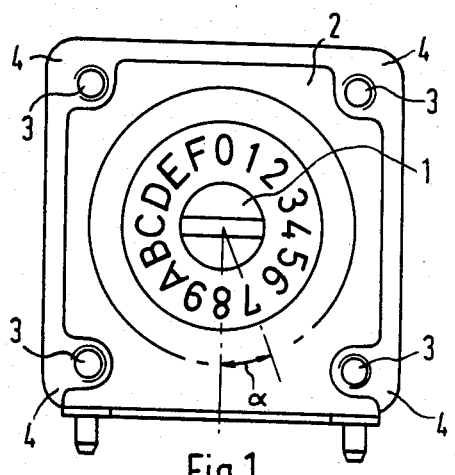
FIG. 1 is a plan view of a rotary multi-position switch without a threaded bushing, as seen from the side of actuation.
Figure 2:
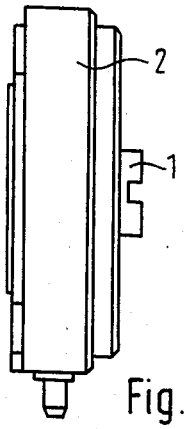
FIG. 2 is a side view of the switch of FIG. 1.

FIG. 1 shows a multistage rotary switch according to the invention as seen from the side of actuation. Around the shaft of 1, for example, on the housing cover 2, there are marked the switch positions in sequences of figures and letters 0 to 9 and A to F respectively. The individual switch positions are staggered with respect to one another by the angle of rotation $\alpha$. In the example of embodiment this is a multi-position rotary switch having 16 stages, therefore, the angle of rotation from one stage to the other respectively amounts to 360 degrees divided by 16 or 22.5 degrees. The holes 3 in the corners 4 serve the mounting of the individual, not shown, switch sections (wafers) capable of being assembled to the housing cover 2 and/or the bottom of the housing with the aid of rivets or screws.

Figure 3:
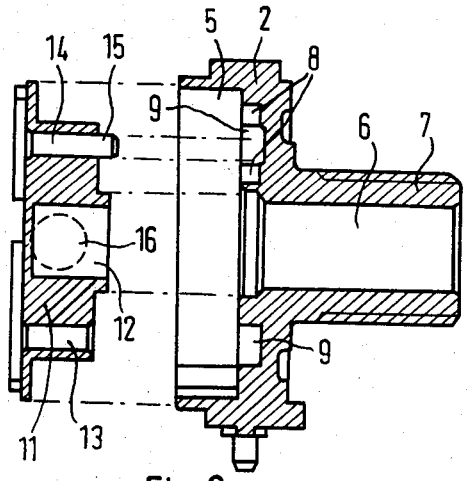
FIG. 3 illustrates a housing cover with a threaded bushing and the associated rotor.
Figure 4:
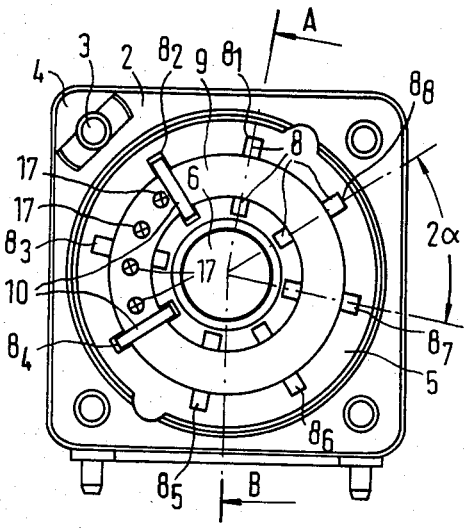
FIG. 4 illustrates the interior view of the housing cover as shown in FIG. 3.

The housing cover 2 as shown in FIGS. 3 and 4 is provided on its inside with a disk-shaped recess 5 and with a shaft bore 6 in a threaded bushing 7 for the rotatable bearing of the shaft (not shown).

On an imaginary circle extending centrically in relation to the bearing bore 6, there are provided radially arranged recesses designed as slots 8 which, in the center part, are interrupted by an annular channel 9 likewise arranged centrically in relation to the bearing bore 6. According to the invention, neighboring slots 8 are each staggered with respect to one another by double the angle of rotation $\alpha$, hence by $2\alpha$. The slots 8 serve to take up a stop element designed as a stop pin 10.

Into the recess 5 of the housing cover 2, a rotor 11 is capable of being inserted in a rotatingly moveable manner, in that the rotor, with the aid of a centrical blind hole 12, is mounted to the inner end of the shaft (not shown). On a circle almost corresponding to the center diameter of the annular channel 9, the rotor 11 is provided with boreholes 13 in which a stop bolt 14 is capable of being firmly inserted. The end 15 of the stop bolt 14 projecting towards the right, projects in the assembled state into the annular channel 9 where it is capable or coming into an operative connection with the stop pins 10. As is known in the art, the rotor 11 may be designed as a detent rotor in that, for example, in lateral openings 16 indicated by dashlines, spring-actuated balls press outwards against the face side of the recess 5 designed as a detent surface.

Figure 5:
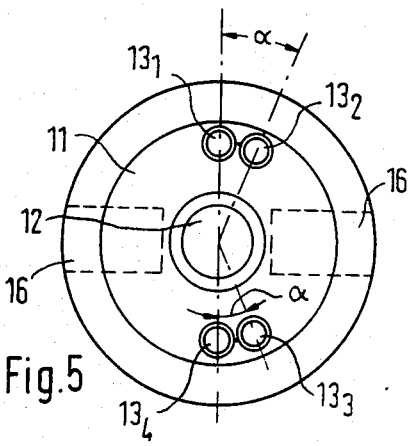
FIG. 5 shows the rotor of FIG. 3 from the side facing the housing cover; and, FIG. 6 shows the rotor of FIG. 3 or FIG. 5 from the side not facing the housing cover.
Figure 6:
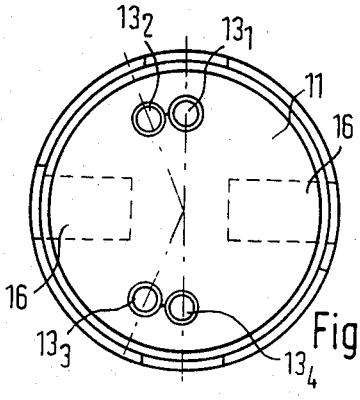

The arrangement of the boreholes 13 according to the invention, is shown in FIGS. 5 and 6. In the view of the rotor 11 as shown in FIG. 6, i.e. in the same viewing direction as the view of the housing cover 2 as shown in FIG. 4, there is arranged one borehole $\mathbf{13}_1$ and one borehole $\mathbf{13}_2$ staggered by an angle of rotation $\alpha$ in the anticlockwise direction, as well as one borehole $\mathbf{13}_1$ staggered by 180 degrees in relation to the borehole $\mathbf{13}_4$, and a borehole $\mathbf{13}_3$ provided next to this one, and staggered by an angle of rotation $\alpha$ in the clockwise direction. The latter could be arranged next to the borehole $\mathbf{13}_1$ by being staggered by the angle of rotation $\alpha$ in the clockwise direction, and the borehole $\mathbf{13}_4$ could be omitted. For stability reasons, however, this is not always possible in the case of small spacings, so that especially in the case of small types there is chosen the arrangement as shown in the drawings. In gerneral, the boreholes $\mathbf{13}_1$ and $\mathbf{13}_4$ may be staggered with respect to one another by an even multiple of the angle of rotation. However, since in the illustrated embodiment the rotor 11 may be designed as a detent rotor, so that the openings 16 must be provided for, it is particularly appropriate to employ the arrangement shown.

The mode of operation of the multi-stage rotary switch according to the invention is as follows:

The slots 8 are indicated by the references $8_1$ to $8_8$. In each of the slots $8_2$ and $8_4$ there is inserted one stop pin 10. Between the small angle formed by the two stop pins 10, there are then included four switching stages which are each denoted by the small circle 17 with a cross therein, referring to the possible position of a stop bolt 14. If now, in the rotor 11, in any one of the boreholes 13, there is inserted a stop bolt 14 and when the latter is positioned within the small angle-of-rotation-span, the denoted four switching stages can be adjusted lockingly if so required. However, in cases where two stop bolts are inserted in neighboring boreholes, such as in $13_1$ and $13_2$, then each switch can only be readjusted by three switching stages, but each time in the division of the angle $\alpha$.

By a corresponding combination of the insertion of one or two stop pins 10 in any one of the radial slots $8_1$ through $8_8$, and by the arrangement of one or two stop bolts 14 in one or two of the boreholes $13_1$ through $13_4$, it is therefore possible to provide all possible varieties of settings at any arbitrary initial position of the rotor 11, i.e. in the fine subdivision of the angle of rotation $\alpha$, although the radial slots 8 are spaced apart by double the angle $\alpha$. Thus, for example, the rotor arrangement is staggered by an angle of rotation $\alpha$ in the anticlockwise direction, when the stop pins 10 engage the radial slots $8_6$ and $8_8$, and when the stop bolts 14 are provided for in the borehole $13_3$ and/or $13_4$, and when the latter move within the small angle-of-rotation span.

In both of the aforementioned cases, and in a corresponding rotor position, the number of stages amounts to 11 or 12, when the stop bolts 14 are capable of moving within the large angle-of-rotation span between the stop pins 10.

Without departing from the idea underlying the invention, the radial slots 8 may also be provided for in the rotor 11, and the stop bolts 14 may be provided for in the housing cover 2. It is also possible to use instead of the slots 8 and the inserted stop pins 10, other limit stops, such as plates, boards, and the like.

What is claimed is:

1. A multi-positionable rotary switch having a plurality of electrically conductive switch positions separated from each other by a given angle of rotation, said rotary switch comprising:

a housing member defining a centrally located aperture;

an annular rotor member rotatably mounted in said housing member;

a plurality of slots extending along radii of the rotating circumference of one of said members for receiving at least one stop means therein to restrict the degree of rotation of said rotor member, said slots being with respect to each other by twice said angle of rotation; and at least one projecting stop on the other of said members positioned to contact said stop means when said stop means are inserted into said slots.

2. The switch of claim 1, wherein said slots are interrupted by an annular channel which receives said projecting stops therein.

3. The switch of claim 1, wherein said other of said members includes at least one hole, and said projecting stop comprises bolt means in and projecting from said hole.

4. The switch of claim 3, wherein said one of said members is said housing member and said other of said members is said rotor member.

5. The switch of claim 1, wherein said one of said members is said housing member and said other of said members is said rotor member.

6. The switch of claim 1, wherein at least two projecting stops are provided on the other of said members.

7. The switch of claim 6, wherein said one of said members is said housing member and said other of said members is said rotor member.

8. The switch of claim 6, wherein said other of said members includes at least a pair of holes and said projecting stops comprise bolt means in and projecting from said holes.

9. The switch of claim 8, wherein said one of said members is said housing member and said other of said members is said rotor member.

10. The switch of claim 1, wherein at least three projecting stops are provided on the other of said members and in which at least two of said projecting stops are staggered from each other at said angle of rotation.

11. The switch of claim 10, wherein said one of said members is said housing member and said other of said members is said rotor member.

12. The switch of claim 10, wherein said other of said members includes at least three holes and said projecting stops comprise bolt means in and projecting from said holes.

13. The switch of claim 12, wherein said one of said members is said housing member and said other of said members is said rotor member.

14. The switch of claim 1, wherein at least four projecting stops are provided on the other of said members.

15. The switch of claim 14, wherein at least two of said projecting stops are angularly spaced from one another by an even numbered multiple of said angle of rotation, one of said projecting stops having a second of said projecting stops spaced therefrom in a clockwise direction by an amount corresponding to said angle of rotation, and the third of said projecting stops having the fourth of said projecting stops spaced from it in an anticlockwise direction also by an amount corresponding to said angle of rotation.

16. The switch of claim 15, wherein said one of said members is said housing member and said other of said members is said rotor member.

17. The switch of claim 15, wherein said other of said members includes at least four holes and said projecting stops comprise bolt means in and projecting from said holes.

18. The switch of claim 17, wherein said one of said members is said housing member and said other of said members is said rotor member.

* * * * *